US006513190B1

(12) United States Patent
Allgeier et al.

(10) Patent No.: US 6,513,190 B1
(45) Date of Patent: Feb. 4, 2003

(54) TURBINE POWERED VACUUM CLEANER NOZZLE

(75) Inventors: David M. J. Allgeier, North Canton, OH (US); Lynn A. Frederick, Brady Lake, OH (US); Jack S. Stayer, Green, OH (US)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 09/556,850

(22) Filed: Apr. 21, 2000

(51) Int. Cl.[7] ..... A47L 9/04
(52) U.S. Cl. ..... 15/387; 15/383
(58) Field of Search ..... 15/383, 387

(56) References Cited

U.S. PATENT DOCUMENTS

| | | | |
|---|---|---|---|
| 3,005,224 | A | 10/1961 | Magarian |
| 5,249,333 | A | 10/1993 | Worwag |
| 5,293,665 | A | 3/1994 | Worwag |
| 5,351,362 | A | 10/1994 | Kramer et al. |
| 5,513,418 | A | 5/1996 | Weber |
| 6,006,402 | A | 12/1999 | Maurer et al. |

FOREIGN PATENT DOCUMENTS

| | | |
|---|---|---|
| EP | 526694 B1 | 6/1992 |
| EP | 526694 A1 | 6/1992 |
| EP | 520175 B1 | 12/1992 |

*Primary Examiner*—Chris K. Moore
(74) *Attorney, Agent, or Firm*—A. Burgess Lowe; Brett A. Schenck

(57) ABSTRACT

A suction cleaner nozzle has a nozzle body enclosing an agitator chamber, which has an elongated suction inlet opening. An agitator is disposed in the agitator chamber such that the agitator extends partially through the suction inlet opening for agitating a surface to be cleaned. A duct is connected to the nozzle body and located adjacent the agitator chamber. The duct extends parallel to the rotative axis of the agitator. A turbine rotor is rotatably connected to the nozzle body and operatively connected to the agitator.

22 Claims, 9 Drawing Sheets

TURBINE POWERED VACUUM CLEANER NOZZLE

BACKGROUND OF THE INVENTION

1. Field of the Invention

This invention relates to a vacuum cleaner nozzle. More particularly, this invention relates to a handheld vacuum cleaner nozzle having an improved nozzle configuration. Even more particularly, this invention pertains to a handheld turbine powered vacuum cleaner nozzle having an improved nozzle configuration. This invention also relates to a turbine powered vacuum cleaner nozzle having a design that facilitates opening and closing of the nozzle housing for cleaning and repair of the nozzle.

2. Summary of the Prior Art

Vacuum cleaners are commonly sold with an assortment of handheld attachments, such as crevice tools, upholstery nozzles and dusting brushes, that attach to the end of the suction hose for various cleaning tasks. When cleaning stairs or upholstery with a handheld suction nozzle, a powered agitator greatly improves the cleaning performance of the tool by dislodging dirt and opening up the carpet pile. Handheld carpet and upholstery nozzles are often provided with a rotary agitator powered by an electric motor or by an air turbine located in the suction path. U.S. Pat. Nos. 3,005,224 and 5,351,362 are examples of turbine powered handheld vacuum cleaner nozzles. In each of these references, a drive belt extends from the axle of an air powered turbine rotor to the agitator, whereby the turbine rotor, which is driven by air drawn in though the suction nozzle, drives the agitator.

Commonly owned U.S. Pat. Nos. 5,513,518 and 6,006,402 each disclose a vacuum cleaner nozzle having an improved suction nozzle configuration that improves the efficiency and cleaning effectiveness of the vacuum cleaner nozzle. The disclosed vacuum cleaner nozzles include specially designed suction ducts extending along the front and/or rear of the agitator chamber. These suction ducts create an airflow within the agitator chamber that is more in harmony with the motion of the rotating agitator than airflow in conventional suction nozzles. As a result, the ducted nozzle captures and directs the dirt drawn into the suction nozzle to the nozzle outlet in a more efficient and effective manner than prior art vacuum cleaner nozzles.

There is a need in the prior art for a handheld upholstery and stair nozzle that has an improved cleaning effectiveness.

SUMMARY OF THE INVENTION

It is an object of the present invention to provide an improved handheld vacuum cleaner nozzle.

It is a further object of the present invention to provide an improved turbine powered vacuum cleaner nozzle.

A further object of the invention is to provide a handheld vacuum cleaner nozzle having an improved suction nozzle configuration.

Another object of the present invention is to provide a turbine powered hand held vacuum cleaner nozzle having an improved suction nozzle configuration.

A further object of the present invention is to provide an improved turbine powered vacuum cleaner nozzle that is easy to open and clean.

These and other objectives will become apparent to one of ordinary skill in the art upon reviewing the attached description and accompanying drawings.

These and other objectives are achieved by the present invention, which in one form provides

BRIEF DESCRIPTION OF THE DRAWINGS

The present invention will now be described by way of example, with reference to the attached drawings, of which.

DETATILED DESCRIPTION OF THE INVENTION

Figure 1:
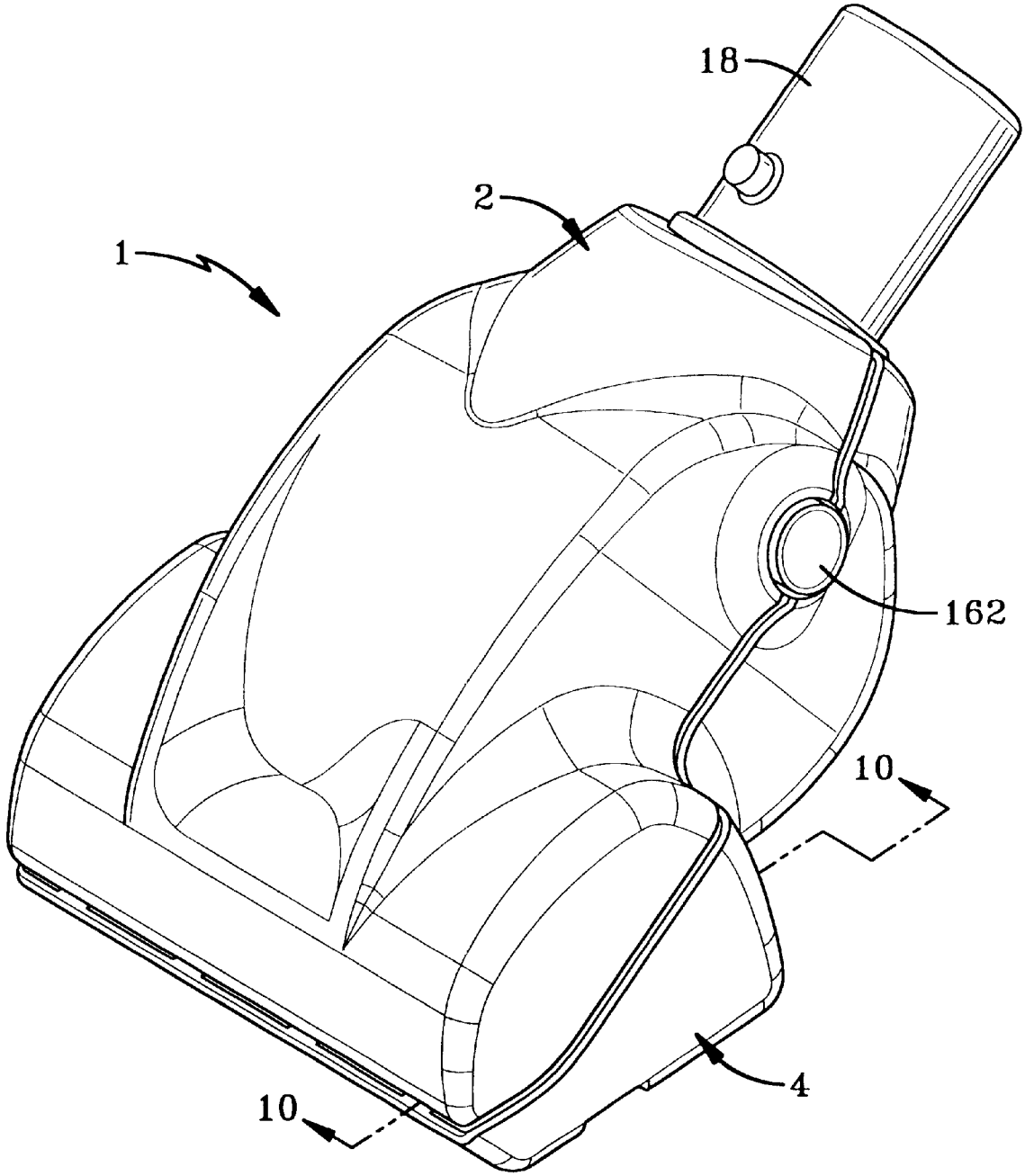
FIG. 1 is a perspective view of a vacuum cleaner suction nozzle according to one form of the present invention.
Figure 2:
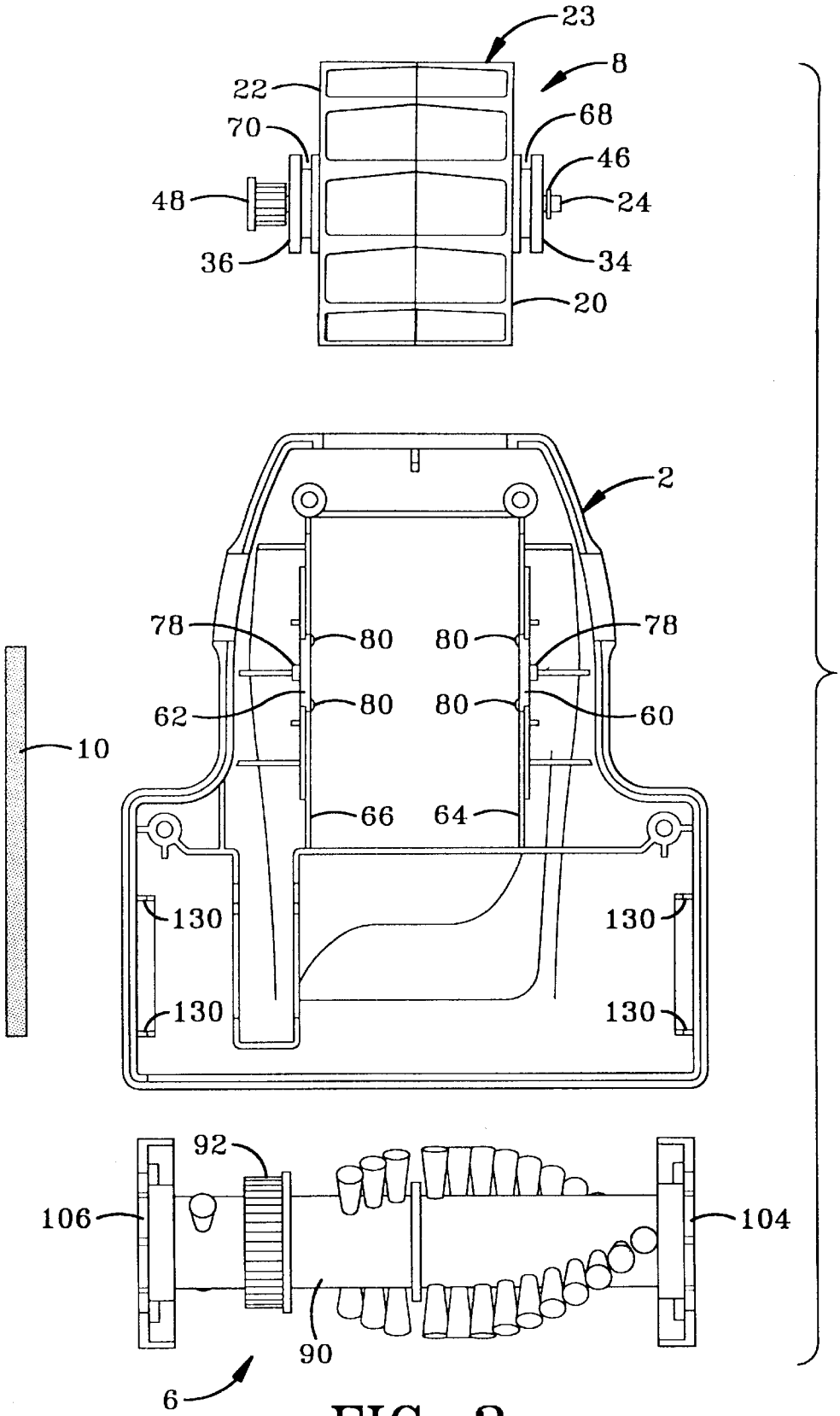
FIGS. 2 and 3 are partially exploded plan views of the upper housing assembly of the vacuum cleaner nozzle of FIG. 1.

Referring now to FIGS. 1 through 5, a handheld vacuum cleaner nozzle according one form of the present invention is generally indicated as 1. The suction nozzle 1 includes a housing formed of an upper housing section 2 and a lower housing section 4 that are releasably joined together in a manner described in further detail below. The upper housing section 2 at least partially encloses an agitator assembly 6, a turbine rotor assembly 8, a drive belt 10, a suction duct/belt guard piece 12, and a suction tube connector 18 (see FIGS. 2 and 3), forming an upper housing assembly (shown fully assembled in FIG. 4). The lower housing section houses a pair of resilient latch arms 14 and 16 (see FIG. 4), defining an upper housing assembly (shown fully assembled in FIG. 5).

Figure 6A:
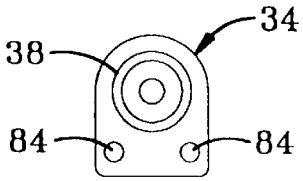
FIGS. 6A and 6B are front and back plan views, respectively, of a rotor retainer.
Figure 6B:
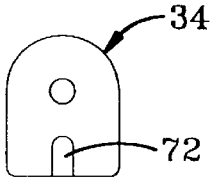
Figure 6:
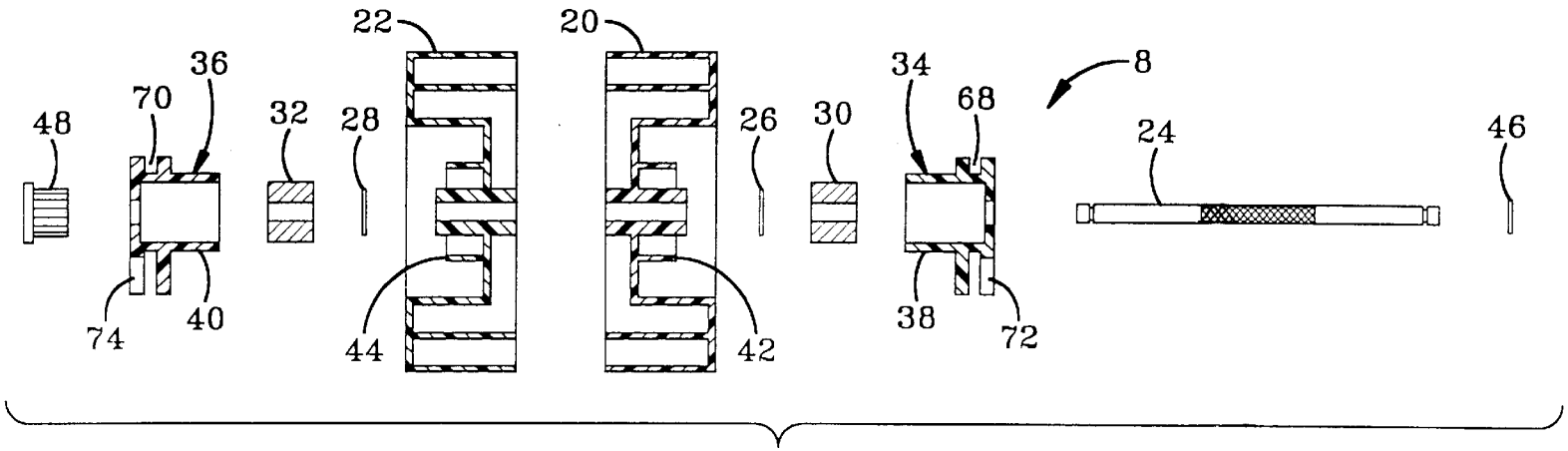
FIG. 6 is an exploded cross-sectional view of the agitator assembly.
Figure 7:
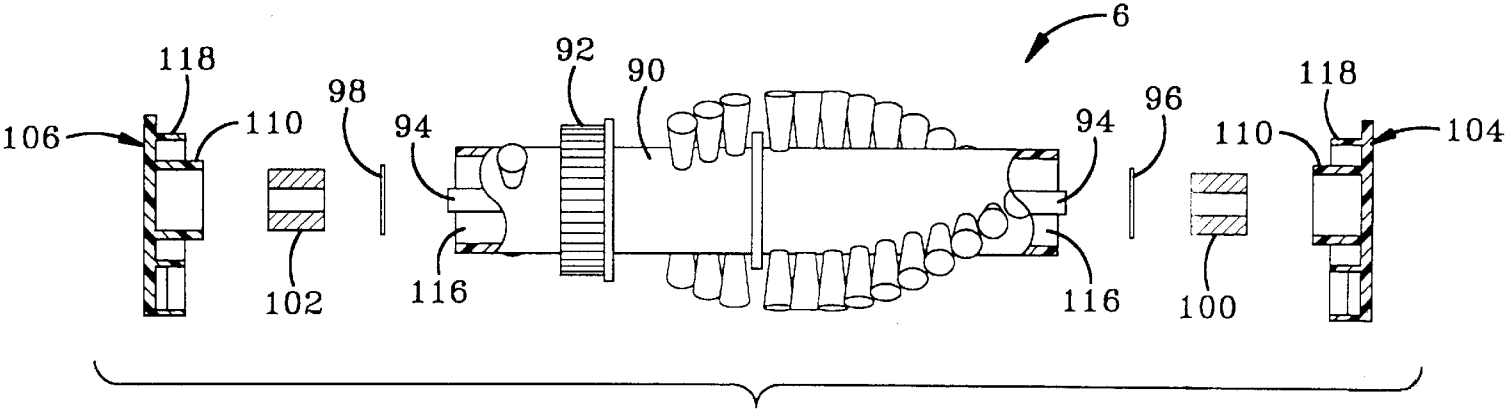
FIG. 7 is a partially exploded partial cross-section of the agitator assembly.

The turbine rotor assembly 8, best illustrated in FIG. 6, is comprised of polycarbonate right and left rotor halves 20 and 22 mounted on a stainless steel rotor axle 24. A central portion of the rotor axle is knurled, such that when rotor halves 20 and 22 are pressed onto either end of the rotor axle 24, the knurling non-rotatably retains the rotor halves on the rotor axle. Thrust washers 26 and 28 are mounted on either end of the rotor axle and abut up against the end faces of the rotor. Bearings 30 and 32 are then mounted on either end of the rotor axle 24 and abut up against the thrust washers. Heat and oil resistant polyester rotor retainers 34 and 36 are mounted on each end of the rotor axle, such that cylindrical portions 38 and 40 of the retainers extend over the bearings 30 and 32. The cylindrical portions 38 and 40 are received in corresponding cylindrical sleeves 42 and 44 formed on the end faces of the rotor, thereby forming labyrinth seals that substantially prevent debris from fouling the bearings. The rotor assembly is secured together by a C-clip 46 attached to a first end of the rotor axle 24 and a sintered iron toothed drive or rotor pulley 48 non-rotatably affixed to the opposite end of the rotor axle.

Figure 3:
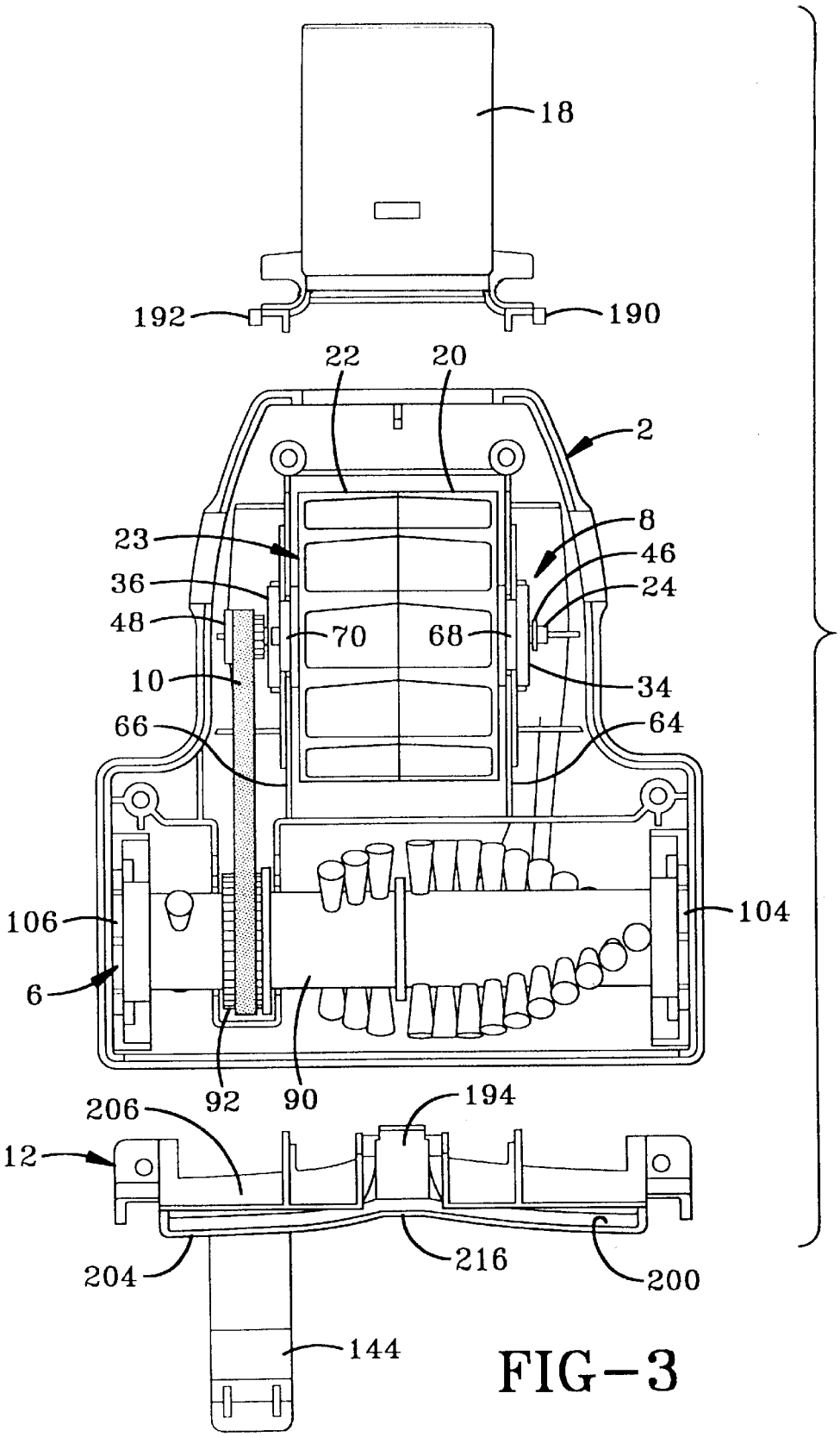

The turbine rotor assembly 8 is mounted in the upper housing section 2 by mounting the rotor retainers 34 and 36 within recesses 60 and 62 (see FIG. 2) formed in the top edge of retaining walls 64 and 66 integrally formed with the upper housing section. The retaining walls are captured in peripheral grooves 68 and 70 formed in the rotor retainers 34 and 36, as shown in FIG. 3. Slots 72 formed in the rotor retainers (see FIG. 6B) receive ridges 78 (see FIG. 2) integrally formed on the retaining walls 64 and 66, whereby the rotor retainers are prevented from rotating relative to the housing. A pair of nubs 80 are formed on the retaining walls (see FIG. 2) and are located to be receive in a corresponding pair of recesses or through holes 84 (see FIG. 6*a*) formed in the rotor retainers. The nubs form a releasable detent connection with the through holes. With this construction, the turbine rotor assembly is retained in the upper housing half when the lower and upper housing halves are separated, but may be easily removed by an operator for inspection and/or cleaning.

Figure 7A:
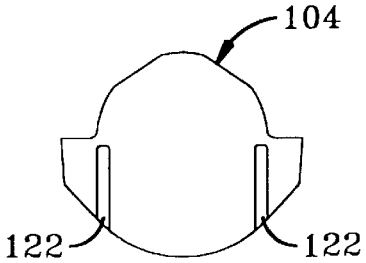
FIG. 7A is a front plan view of an agitator tread guard.

The agitator assembly 6, best illustrated in 7, includes an agitator body 90 having an integrally molded toothed driven or agitator pulley 92. The agitator body is formed of blown ABS plastic. An agitator axle 94 is formed of two stainless steel shafts press fit into corresponding bores in the ends of the agitator body. Heat and oil resistant polyester thrust washers 96 and 98 are slid over either end of the agitator axle, followed by sintered bronze bearings 100 and 102. Thread guards 104 and 106 are then attached to either ends of the agitator axle 94. The thread guards include inner cylindrical sleeves 110 that extend over the bearings 100 and 102 into annular cavities 116 formed in the ends of the agitator body. Thread guards 104 and 106 also include outer cylindrical sleeves 118 that extend over the outer ends of the agitator body. Thus, the inner and outer annular sleeves cooperate with the ends of the agitator body to form labyrinth seals that substantially prevent threads and other debris from fouling the bearings 100 and 102. A pair of grooves 122 (see FIG. 7*a*) are formed in the outer end face of each of the thread guards 104 and 106. The rotor assembly is mounted in the upper housing section 2 with ridges 130 integrally formed in the upper housing section (see FIG. 2) slidably received in the grooves 122 in the thread guards. Thus the thread guards are non-rotatably mounted in the upper housing section.

Figure 4:
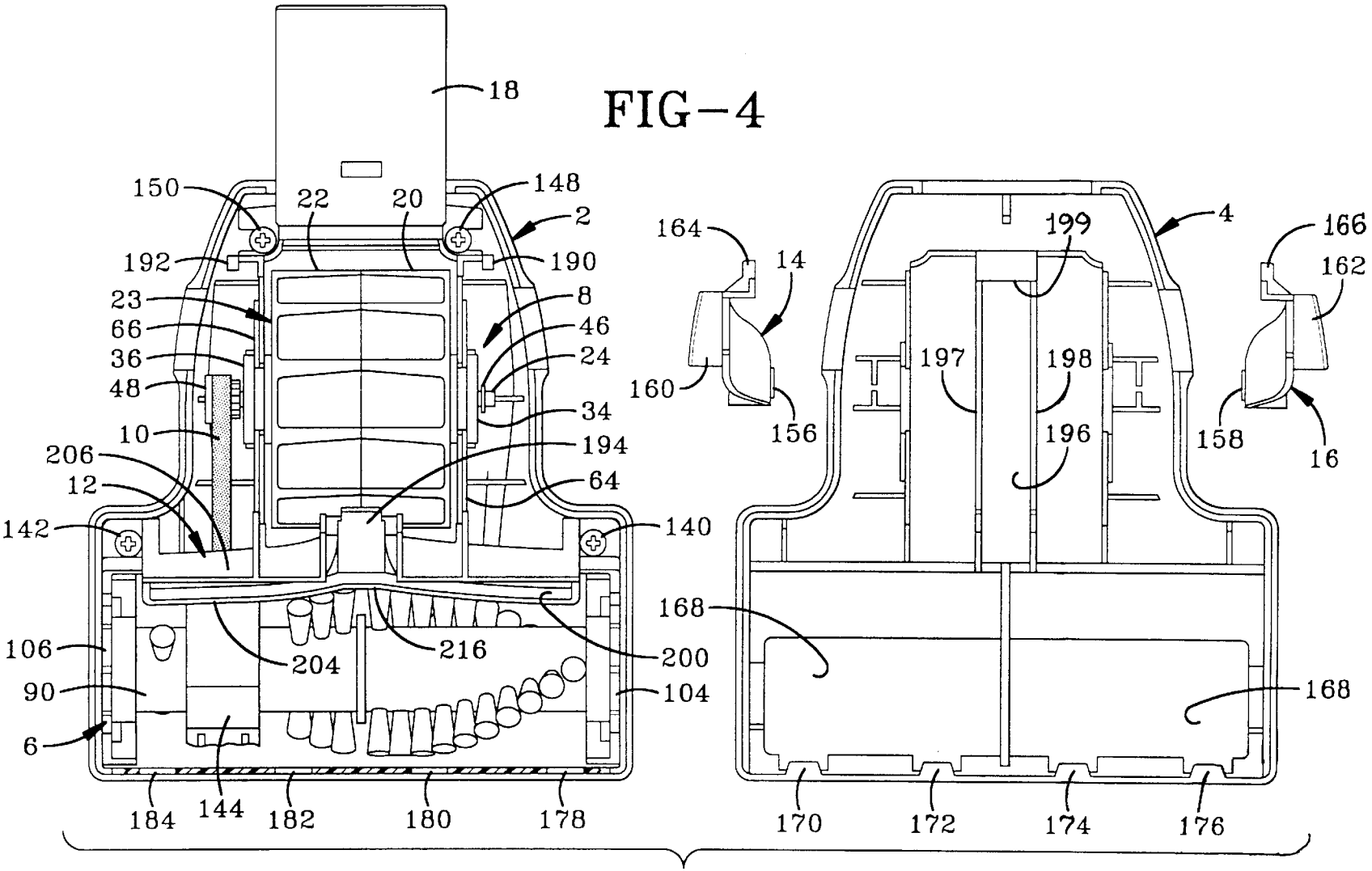
FIG. 4 is a plan view of the upper housing assembly and an exploded plan view of the lower housing assembly.
Figure 4A:
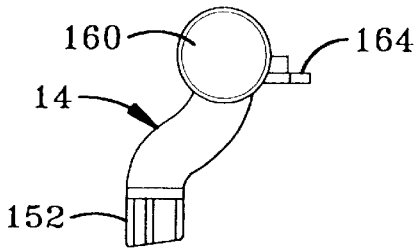
FIGS. 4A and 4B are front and back plan views, respectively, of a latch arm.
Figure 4B:
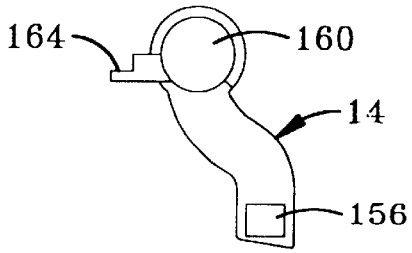

The toothed drive belt 10 extends between the rotor pulley 48 and the agitator pulley 92. The drive belt is mounted upon the agitator pulley prior to insertion of the agitator assembly into the upper housing section 2. After insertion of the agitator assembly and the drive belt into the upper housing section, as illustrated in FIG. 3, the belt guard/suction duct piece 12 is securely attached to the upper housing section 2 using two screws 140 and 142, as shown in FIG. 4. Belt guard portion 144 extends over the agitator belt and the agitator pulley. The belt guard covers the agitator pulley and drive belt in the agitator chamber, and thereby substantially prevents hair and other debris from fouling the agitator pulley 92. The belt guard also retains the agitator assembly 6 within the upper housing section, thereby preventing the agitator assembly from falling out of the upper housing section when the housing is opened. The turbine rotor assembly 8 is then mounted in the upper housing section and the drive belt is looped over the rotor pulley 48. The upper housing assembly is completed by attaching the suction tube connector 18 using two screws 148 and 150, as shown in FIG. 4.

Figure 5:
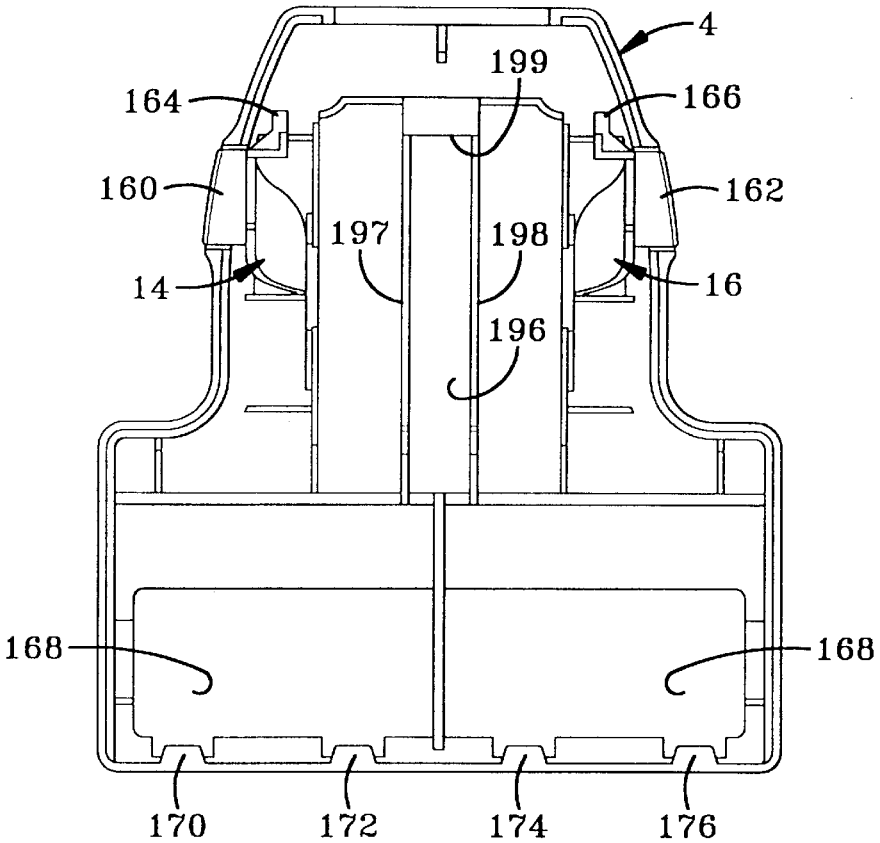
FIG. 5 is a plan view of the lower housing assembly.

The lower housing assembly, illustrated in FIGS. 4 and 5, includes the lower housing section 4 and the resilient latch arms 14 and 16. The resilient latch arms have inner ends 152 with catches 156 and 158 integrally formed therewith that permanently snap into the lower housing as shown in FIG. 5. The latch arms also include integrally formed finger buttons 160 and 162 and latch fingers 164 and 166. The latch arms are formed of any suitable resilient material, such as Acetal. The latch arms yield in cantilever fashion about their inner ends 152 and 154 when the finger buttons 160 and 162 are depressed and spring back to their original position when the finger buttons are released.

A suction inlet opening 168 is formed in the lower housing section. The suction inlet opening opens into the agitator chamber. When the two housing sections are assembled, the bristles on the agitator extend through the suction inlet opening for agitating a surface being cleaned.

Figure 8:
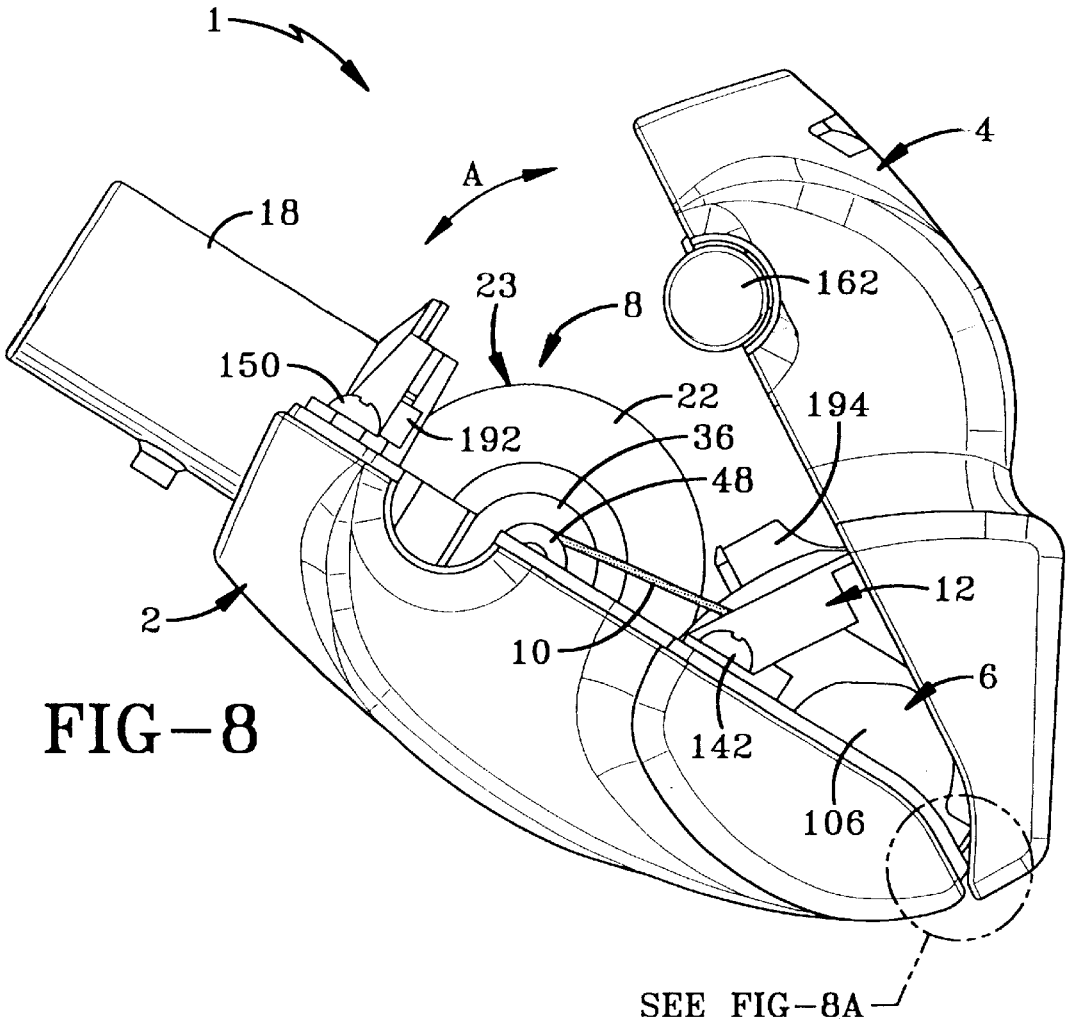
FIG. 8 is a side view of the vacuum cleaner suction nozzle of FIG. 1, illustrating how the two housing halves are opened and closed.
Figure 8A:
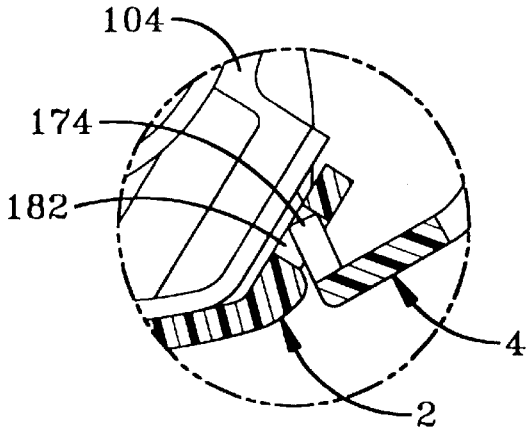
FIG. 8*a* is an enlarged cross-section of portion 8A of FIG. 8.
Figure 9:
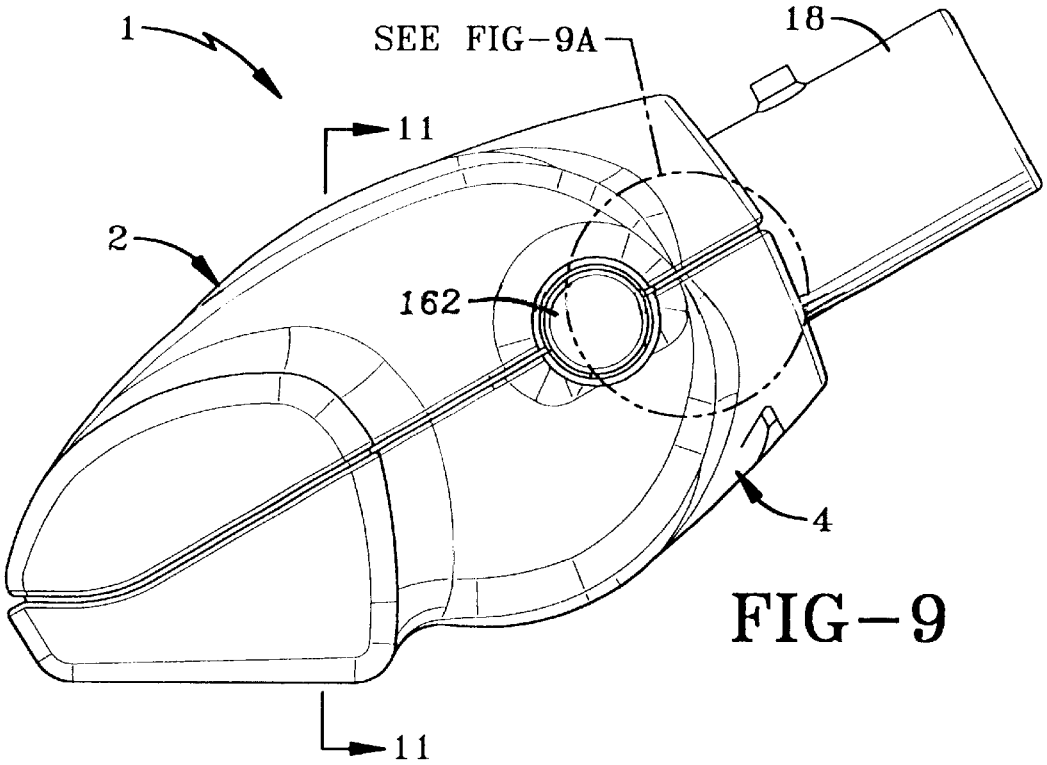
FIG. 9 is a side view of the suction nozzle of FIG. 1.
Figure 9A:
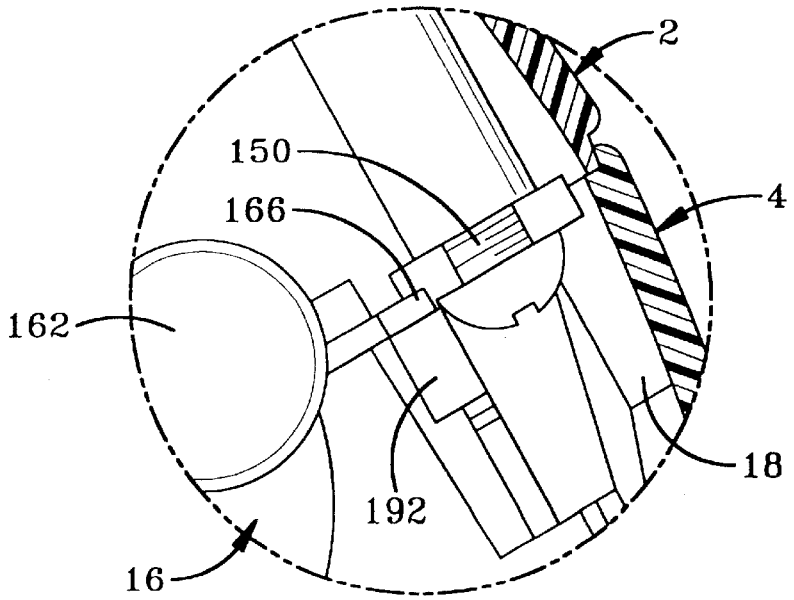
FIG. 9*a* is an enlarged cross-section of portion 9A of FIG. 9.

The upper and lower housing assemblies are assembled together by first inserting tabs 170, 172, 174, and 176 integrally formed on a front edge of the lower housing section 4 (see FIG. 4) into corresponding slots 178, 180, 182, and 184 formed in the front edge of the upper housing section 2 (see FIG. 4), as shown in FIGS. 8 and 8*a*. The upper and lower housing sections are then pivoted toward to each other, as indicated by arrow A in FIG. 8, and pressed together, as illustrated in FIG. 9, until the latch fingers 164 and 166 on the latch arms 16 and 14 cam over and latch onto catches 190 and 192 (see FIG. 3) integrally formed on the connector 18. The two housing sections are thereby securely latched together. At least one of the latch fingers and the catches are preferably chamfered, in order to facilitate the camming of the latch fingers over the catches when the housing sections are pressed together.

The upper and lower housings are easily separated for inspection, cleaning, and repair of the nozzle simply by depressing the finger buttons 160 and 162 by squeezing the finger buttons between the thumb and a finger of a single hand, while holding the upper housing section 2 in the other hand, and pulling the two housing sections apart. Thus, the present invention provides a very simple and convenient operation, i.e. squeeze and pull, by which the upper 2 and lower 4 housing sections may be separated. When the two housing sections are separated, the turbine rotor assembly 8 and the agitator assembly 6 are retained in the upper housing section, as previously described. The rotor may be easily removed simply by pulling on the rotor 23 with sufficient force to overcome the detent connection between the nubs 80 and the through holes 84. If necessary, the agitator and/or the drive belt may be removed by removing screws 140 and 142, removing the belt guard suction/suction duct piece 12, and removing the agitator assembly 6 from the upper housing.

During operation, the suction nozzle 1 is attached to a suction wand or the end of a suction hose of a vacuum cleaner via connector 18. The suction created by the vacuum cleaner draws air in through the suction inlet opening 168, through the agitator chamber, through an agitator outlet 194 into contact with a turbine rotor 23 and out the discharge port or connector 18. The agitator outlet 194 (see FIGS. 3, 4, and 8) is a tapered channel integrally formed with the suction duct/belt guard piece 12. The agitator outlet is shaped, oriented and located to direct a jet of air at the center of the turbine blades on the rotor 23. The jet of air is directed substantially tangent to the rotor, in order to rotate the rotor. For maximum efficiency and power, the jet of air is directed into a conventional turbine inlet volute 196 (see FIG. 5) defined by walls 197, 198 and 199 integrally molded with the lower housing section 4. As the turbine rotor rotates, the drive belt 10 drives the agitator.

To further maximize performance of the nozzle, the retaining walls 64 and 66 on the upper housing section at least partially overlap with corresponding walls integrally molded into the lower housing section 4. The overlapping walls form labyrinth seals that minimize leakage of air into the turbine chamber and thereby maximize the amount of air entering the suction inlet 168 for picking up dirt and passing through the agitator outlet 194 for driving the rotor 23.

Figure 10:
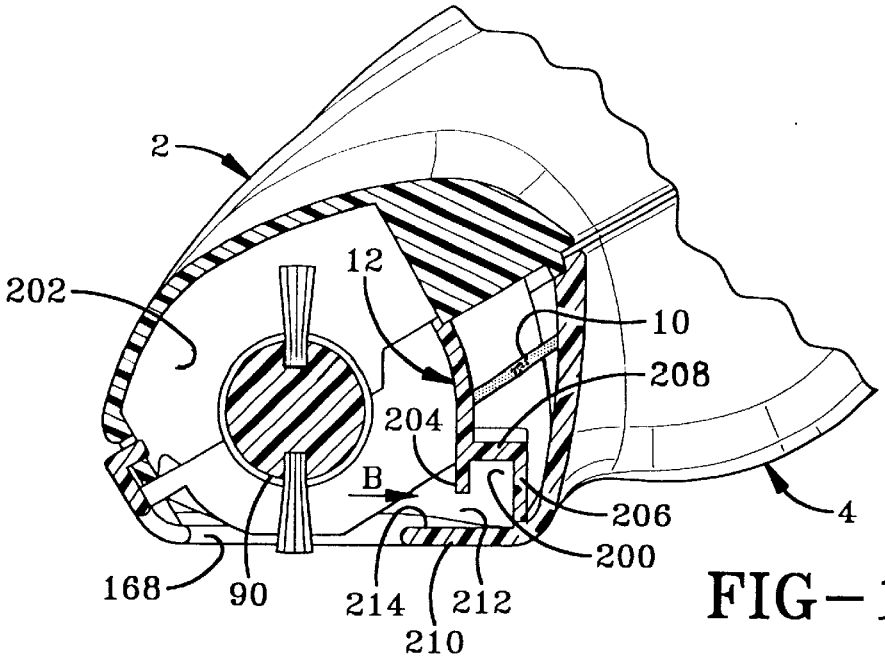
FIG. 10 is a partial cross-section taken along line 10—10 in FIG. 1.
Figure 11:
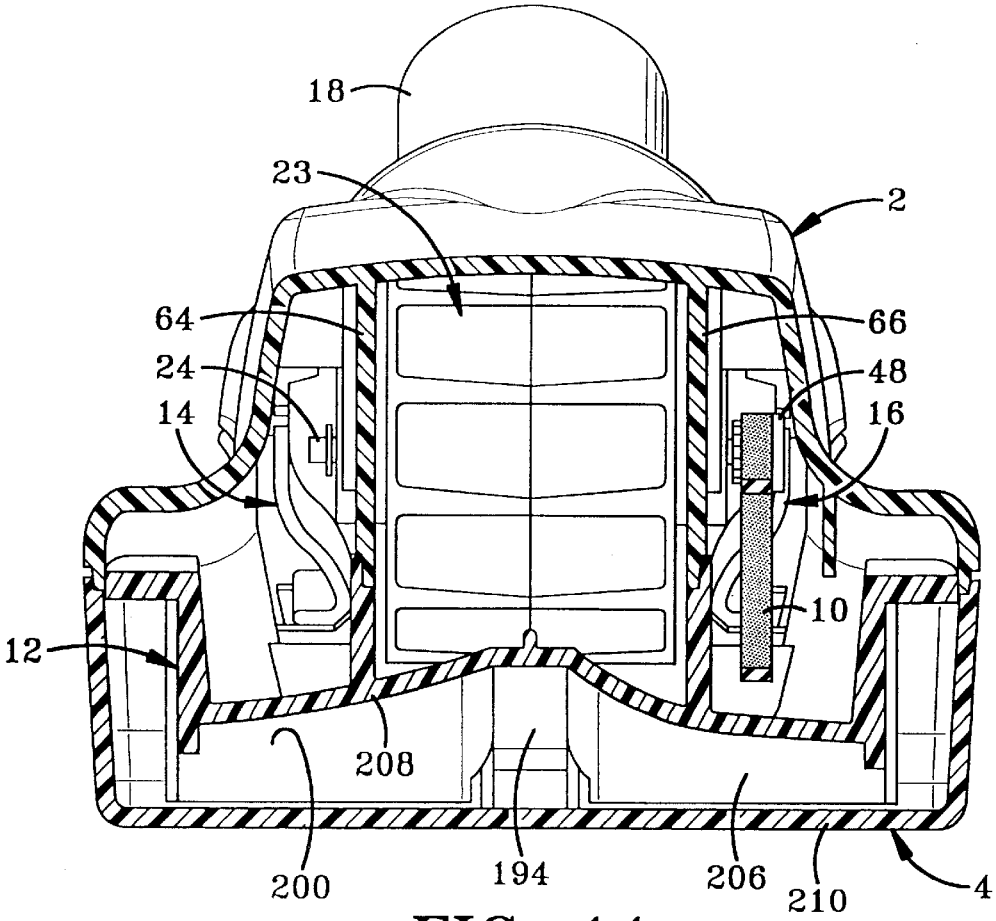
FIG. 11 is a cross section taken along line 11—11 in FIG. 9.

Best seen in FIGS. 10 and 11, belt guard/suction duct piece 12 forms a sidewardly extending duct 200 along the rear edge of the agitator chamber 202 and adjacent to the rear edge of the suction inlet opening 168. As viewed in FIG. 10, the sidewardly extending duct 200 is defined by an inner vertically extending wall 204, an outer vertically extending wall 206, an upper wall 208 and a lower wall 210. The lower wall 210 is spaced from the lower edge of the inner vertical wall 204 defining a suction slot 212 there between. The lower wall 210 extends inwardly of the inner vertical wall 204 forming a ledge 214 in the agitator chamber for capture of debris thereon. The central portion of the inner vertically extending wall 204 preferably has a recess or cut-out 216 (see FIG. 3) formed in the lower edge thereof opposite the agitator outlet 194. The recess or cutout provides an area through which large dirt and debris, that would otherwise jam in the relatively narrow suction slot 212, may pass through.

In operation, a majority of the dirt and debris picked up by the agitator (as illustrated by arrow B in FIG. 10) is thrown substantially horizontally by the agitator directly through the suction slot 212 and into the sidewardly extending duct 200. The dirt then travels along the sidewardly extending duct to the agitator outlet 194. As best seen in FIG. 11, the sidewardly extending duct has an expanding cross-sectional area approaching the agitator chamber outlet 194. The expanding cross-sectional area of the sidewardly extending duct is designed to provide a substantially constant air flow characteristic across the suction slot 212. Thus, the rate of air flowing from the agitator chamber, through the suction slot and into the sidewardly extending duct is substantially constant across the width of the nozzle. As a result, the airflow in the agitator chamber is in the same direction that the dirt is substantially thrown by the agitator i.e. along arrow B, as opposed to a conventional suction nozzle that has a large lengthwise component to the airflow in the agitator chamber, i.e. into or out of the paper in FIG. 10.

It will be appreciated by one of ordinary skill in the art that a pair of sidewardly extending ducts, namely one located along the front edge of the agitator chamber (not shown) and one located along the rear edge of the agitator chamber may be provide. U.S. Pat. Nos. 6,006,402 and 5,513,418, the disclosures of which are hereby incorporated herein by reference, disclose such a dual duct nozzle configuration. Similarly, it will be appreciated the sidewardly extending duct may alternatively be provided only along the front edge of the agitator chamber. When a sidewardly extending duct is provided along the front edge of the agitator chamber 202, a communicating passageway (not shown) must be provided that extends over the agitator cavity into communication with the agitator outlet 194, as disclosed in previously incorporated U.S. Pat. Nos. 5,513,418 and 6,006,402.

The materials set forth above for various parts of the nozzle 1 are provided as examples of suitable materials for these parts, in order to provide a complete and enabling disclosure of the invention. One of skill in the art will appreciate that other suitable materials may be used in place of the specific materials disclosed above, without affecting the performance or utility of the disclosed invention. As such, all the materials disclosed above for different parts of the disclosed device are intended as examples of suitable materials only, and are not intended to limit the invention to any such specifically disclosed material.

The invention has been described, by way of example above, with reference to one form of the invention. Various modifications and alternate embodiments will be apparent to one of ordinary skill in the art upon reviewing the proceeding description and accompanying drawings. The present invention is intended to be limited only by the attached claims and not by the detailed description of one form of the present invention provided by way of example above.

What is claimed is:

1. A suction cleaner nozzle comprising:

a nozzle body enclosing an agitator chamber having an elongate suction inlet opening;

an agitator disposed in said agitator chamber such that said agitator extends partially through said suction inlet opening for agitating a surface to be cleaned;

a duct connected to said nozzle body and located adjacent said agitator chamber, said duct extending parallel to the rotative axis of said agitator;

a discharge port disposed in said duct;

a turbine rotor rotatably connected to said nozzle body and operatively connected to said agitator; and a suction tube connector fluidly connected to said nozzle body, said suction tube connector being positioned a distance from said surface not less than the distance between the rotative axis of the turbine rotor and said surface when said agitator is positioned to agitate said surface.

2. A suction cleaner nozzle according to claim 1, wherein said duct is defined by a pair of generally vertical walls joined by a top wall.

3. A suction cleaner nozzle according to claim 2, wherein a first of said vertical walls separates said duct from said agitator chamber and a second of said vertical walls is remote from said agitator chamber.

4. A suction cleaner nozzle according to claim 3, wherein said duct is further defined by a bottom wall that extends substantially horizontally from a lower edge of said second vertical wall toward said agitator chamber, said bottom wall being spaced below a lower edge of said first vertical wall defining an elongated slot communicating said duct with said agitator chamber.

5. A suction cleaner nozzle according to claim 4, wherein said discharge port is located in said second wall and a relief cutout is formed in said first wall substantially opposite said discharge port.

6. A suction cleaner nozzle according to claim 4, wherein said bottom wall extends beyond said first vertical wall.

7. A suction cleaner nozzle according to claim 4, wherein said pair of vertical walls diverge approaching said discharge port.

8. A suction cleaner nozzle according to claim 4, wherein said top and bottom walls diverge approaching said discharge port.

9. A suction nozzle according to claim 1, wherein said duct is positioned adjacent said turbine rotor and said discharge port is located substantially at the center of the circumferential end of said turbine rotor.

10. A suction nozzle according to claim 1, wherein said duct extends along a rear side of said agitator chamber.

11. A suction cleaner nozzle comprising:

a nozzle body enclosing an agitator chamber a suction inlet opening;

an agitator disposed in said agitator chamber such that said agitator extends partially through said suction inlet opening for agitating a surface to be cleaned;

a turbine rotor operatively connected to said agitator; and a detent assembly releasably connecting said turbine rotor to said nozzle body.

12. The suction cleaner nozzle of claim 11 wherein said detent assembly includes at least a pair of retaining walls attached to said nozzle body and at least a pair of rotor retainers connected to said turbine rotor, said retaining walls having a plurality of nubs, and said rotor retainers having a plurality of recesses for receiving said nubs.

13. The suction cleaner of claim 12 including an axle, said turbine rotor being mounted on said axle, said rotor retainers being rotatably connected to said axle, and an anti-rotational assembly formed on said rotor retainers and said retaining walls which prevents said rotor retainers from rotating when releasably connected to said retaining walls.

14. The suction cleaner of claim 13 wherein said anti-rotational assembly includes a plurality of ribs formed on said retaining walls and a plurality of slots formed in said rotor retainers for receiving said ribs to prevent rotation of said rotor retainers.

15. A suction cleaner nozzle comprising:

a nozzle body enclosing an agitator chamber having an elongate suction inlet opening;

an agitator disposed in said agitator chamber such that said agitator extends partially through said suction inlet opening for agitating a surface to be cleaned;

a duct connected to said nozzle body and located adjacent said agitator chamber, said duct extending parallel to the rotative axis of said agitator;

a discharge port disposed in said duct;

a turbine rotor rotatably connected to said nozzle body and operatively connected to said agitator;

wherein said duct is defined by a pair of generally vertical walls joined by a top wall, a first of said vertical walls separates said duct from said agitator chamber and a second of said vertical walls is remote from said agitator chamber; and wherein said discharge port is located in said second wall and a relief cutout is formed in said first wall substantially opposite said discharge port.

16. A suction cleaner nozzle comprising:

a nozzle body enclosing an agitator chamber having an elongate suction inlet opening;

an agitator disposed in said agitator chamber such that said agitator extends partially through said suction inlet opening for agitating a surface to be cleaned;

a duct connected to said nozzle body and located adjacent said agitator chamber, said duct extending parallel to the rotative axis of said agitator;

a discharge port disposed in said duct;

a turbine rotor rotatably connected to said nozzle body and operatively connected to said agitator;

wherein said duct is defined by a pair of generally vertical walls joined by a top wall, a first of said vertical walls separates said duct from said agitator chamber and a second of said vertical walls is remote from said agitator chamber; and wherein said pair of vertical walls diverge approaching said discharge port.

17. A suction cleaner nozzle comprising:

a nozzle body enclosing an agitator chamber having an elongate suction inlet opening;

an agitator disposed in said agitator chamber such that said agitator extends partially through said suction inlet opening for agitating a surface to be cleaned;

a duct connected to said nozzle body and located adjacent said agitator chamber, said duct extending parallel to the rotative axis of said agitator;

a discharge port disposed in said duct;

a turbine rotor rotatably connected to said nozzle body and operatively connected to said agitator;

wherein said duct is defined by a pair of generally vertical walls joined by a top wall, a first of said vertical walls separates said duct from said agitator chamber and a second of said vertical walls is remote from said agitator chamber;

said duct is further defined by a bottom wall that extends substantially horizontally from a lower edge of said second vertical wall toward said agitator chamber, said bottom wall being spaced below a lower edge of said first vertical wall defining an elongate slot communicating said duct with said agitator chamber; and wherein said discharge port is located in said second wall and a relief cutout is formed in said first wall substantially opposite said discharge port.

18. A suction cleaner nozzle comprising:

a nozzle body enclosing an agitator chamber having an elongate suction inlet opening;

an agitator disposed in said agitator chamber such that said agitator extends partially through said suction inlet opening for agitating a surface to be cleaned;

a duct connected to said nozzle body and located adjacent said agitator chamber, said duct extending parallel to the rotative axis of said agitator;

a discharge port disposed in said duct;

a turbine rotor rotatably connected to said nozzle body and operatively connected to said agitator;

wherein said duct is defined by a pair of generally vertical walls joined by a top wall, a first of said vertical walls separates said duct from said agitator chamber and a second of said vertical walls is remote from said agitator chamber;

said duct is further defined by a bottom wall that extends substantially horizontally from a lower edge of said second vertical wall toward said agitator chamber, said bottom wall being spaced below a lower edge of said first vertical wall defining an elongate slot communicating said duct with said agitator chamber;

and wherein said pair of first vertical walls diverge approaching said discharge port.

19. A suction cleaner nozzle comprising:

a nozzle body enclosing an agitator chamber having an suction inlet opening;

an agitator disposed in said agitator chamber such that said agitator extends partially through said suction inlet opening for agitating a surface to be cleaned;

a duct connected to said nozzle body and located adjacent said agitator chamber, said duct extending parallel to the rotative axis of said agitator;

a discharge port disposed in said duct;

a turbine rotor rotatably connected to said nozzle body and operatively connected to said agitator;

wherein said duct is defined by a pair of generally vertical walls joined by a top wall, a first of said vertical walls separates said duct from said agitator chamber and a second of said vertical walls is remote from said agitator chamber;

said duct is further defined by a bottom wall that extends substantially horizontally from a lower edge of said second vertical wall toward said agitator chamber, said bottom wall being spaced below a lower edge of said first vertical wall defining an elongate slot communicating said duct with said agitator chamber; and wherein said top and bottom walls diverge approaching said discharge port.

20. A suction cleaner nozzle comprising:

a nozzle body enclosing an agitator chamber having a suction inlet opening;

an agitator disposed in said agitator chamber such that said agitator extends partially through said suction inlet opening for agitating a surface to be cleaned;

a turbine rotor operatively connected to said agitator;

a retaining assembly connecting said turbine rotor and said nozzle body such that said turbine rotor is releasably connected to said nozzle body;

wherein said retaining assembly includes at least a pair of retaining walls attached to said nozzle body and at least a pair of rotor retainers connected to said turbine rotor, said retaining walls having a plurality of nubs, and said rotor retainers having a plurality of recesses for receiving said nubs.

21. The suction cleaner of claim 20 including an axle, said turbine rotor being mounted on said axle, said rotor retainers being rotatably connected to said axle, and an anti-rotational assembly formed on said rotor retainers and said retaining walls which prevents said rotor retainers from rotating when releasably connected to said retaining walls.

22. The suction cleaner of claim 21 wherein said anti-rotational assembly includes a plurality of ribs formed on said retaining walls and a plurality of slots formed in said rotor retainers for receiving said ribs to prevent rotation of said rotor retainers.

* * * * *